US008376182B2

(12) United States Patent
Lepage

(10) Patent No.: US 8,376,182 B2
(45) Date of Patent: Feb. 19, 2013

(54) CLOSURE WITH MEANS FOR RETAINING THE LID IN AN OPEN POSITION

(75) Inventor: Francis Lepage, Dommartin (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 13/246,173

(22) Filed: Sep. 27, 2011

(65) Prior Publication Data

US 2012/0067915 A1 Mar. 22, 2012

Related U.S. Application Data

(63) Continuation of application No. PCT/GB2010/000894, filed on May 4, 2010.

(30) Foreign Application Priority Data

May 7, 2009 (GB) ..... 0907867.6

(51) Int. Cl.
*B65D 47/08* (2006.01)

(52) U.S. Cl. ..... 220/831; 222/556; 215/235

(58) Field of Classification Search ..... 215/235, 215/237; 220/254.3, 254.5, 831, 832, 910, 220/820, 821, 823, 824; 222/562, 556
See application file for complete search history.

(56) References Cited

U.S. PATENT DOCUMENTS

| | | | | |
|---|---|---|---|---|
| 5,328,058 | A * | 7/1994 | Leoncavallo et al. | 215/237 |
| 5,605,254 | A | 2/1997 | Wagner, III et al. | |
| 6,478,184 | B2 * | 11/2002 | Berge et al. | 220/831 |
| 6,484,895 | B2 * | 11/2002 | Montgomery et al. | 215/237 |
| 7,617,954 | B2 * | 11/2009 | Skillin | 220/831 |
| 7,735,665 | B2 * | 6/2010 | Robinson | 215/237 |
| 2004/0005883 | A1 | 1/2004 | Lee | |
| 2006/0016776 | A1 | 1/2006 | Barre et al. | |
| 2007/0017939 | A1 | 1/2007 | Conroy et al. | |
| 2008/0035681 | A1 | 2/2008 | Skillin | |
| 2008/0078763 | A1 | 4/2008 | Auer | |

FOREIGN PATENT DOCUMENTS

| | | |
|---|---|---|
| DE | 2009000138 | 4/2009 |
| EP | 1319605 | 6/2003 |
| JP | 2008155924 | 12/2006 |
| WO | 02098756 | 12/2002 |

OTHER PUBLICATIONS

Search Report from GB Application No. 0907867.6 issued on Jul. 9, 2009.

The International Search Report and Written Opinion issued in connection with PCT Application No. PCT/GB2010/000894, mailed on Jul. 21, 2010.

* cited by examiner

*Primary Examiner* — Andrew Perreault
(74) *Attorney, Agent, or Firm* — Alleman Hall McCoy Russell & Tuttle LLP

(57) ABSTRACT

A closure having a base and a lid is provided. The lid is movable between a closed and an open position. The closure comprises retaining means for stably retaining the lid in the open position.

18 Claims, 5 Drawing Sheets

CLOSURE WITH MEANS FOR RETAINING THE LID IN AN OPEN POSITION

PRIORITY INFORMATION

The present application is a continuation of PCT Application No. PCT/GB2010/000894, filed on May 4, 2010, that claims priority to GB Application No. 0907867.6, filed on May 7, 2009, both of which are incorporated herein by reference in their entireties.

BACKGROUND OF THE INVENTION

The present invention relates generally to a closure and particularly to a closure with two or more parts which need to be held stably in a set position with respect to each other.

It is known to provide closures with two or more parts which are movable with respect to each other, for example a lid and a base.

In many cases it would be an advantage to be able to hold two parts of such closures in a required relative position or orientation with respect to each other. For example, where a closure comprises a lid and a base it might be desirable to be able to hold the lid stably in an open position with respect to the base in order to help with dispensing product.

In known closures the parts may be articulated or otherwise movable with respect to each other and capable of being held stably in a closed position. However the open position of such closures is not defined and is not stable.

The present invention seeks to address the problems with known closures.

SUMMARY OF THE INVENTION

According to a first aspect of the present invention there is provided a closure having a base and a lid, the lid being movable between a closed and an open position, the closure comprising means for stably retaining the lid in the open position.

The present invention therefore provides a closure which can be moved to an open position and held stably in that position without further user intervention. This could be particularly useful, for example, in a dispensing closure where it is useful if the lid is moved and held away from the base in order to allow dispensing.

The base and lid may include co-operating interengaging surface formations for holding the lid in the open position.

The surface formations may comprise interdigitating projections such as a plurality of ribs, splines, knurls or the like.

The interengagement may comprise a friction fit. Alternatively or additionally other interactions, such as adhesion or magnetism, could be used to retain the lid.

The lid retention may be reversible. However, if desired the retention could be permanent to prevent closure of the lid.

The base and lid may be joined by an articulation point, such as a hinge. The surface formations may be provided in the region of the articulation point.

The closure may further comprise tamper evident means.

According to a second aspect there is provided a closure having at least two parts movable between the first and second positions with respect to each other, the parts comprising respective co-operating interdigitating surface formations for holding them in the first and/or second position.

The present invention will now be more particularly described, by way of example, with reference to the accompanying drawings, in which:

DETAILED DESCRIPTION OF THE ILLUSTRATED EMBODIMENTS

Figure 1:
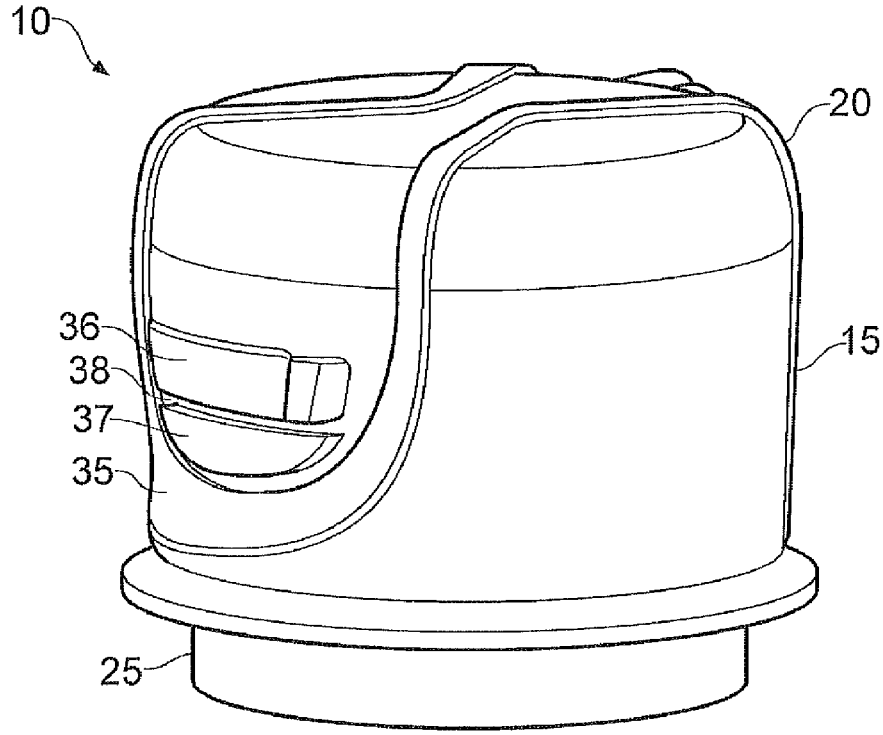
FIG. 1 is a perspective view of a closure formed according to the present invention shown fitted to a container.
Figure 2:
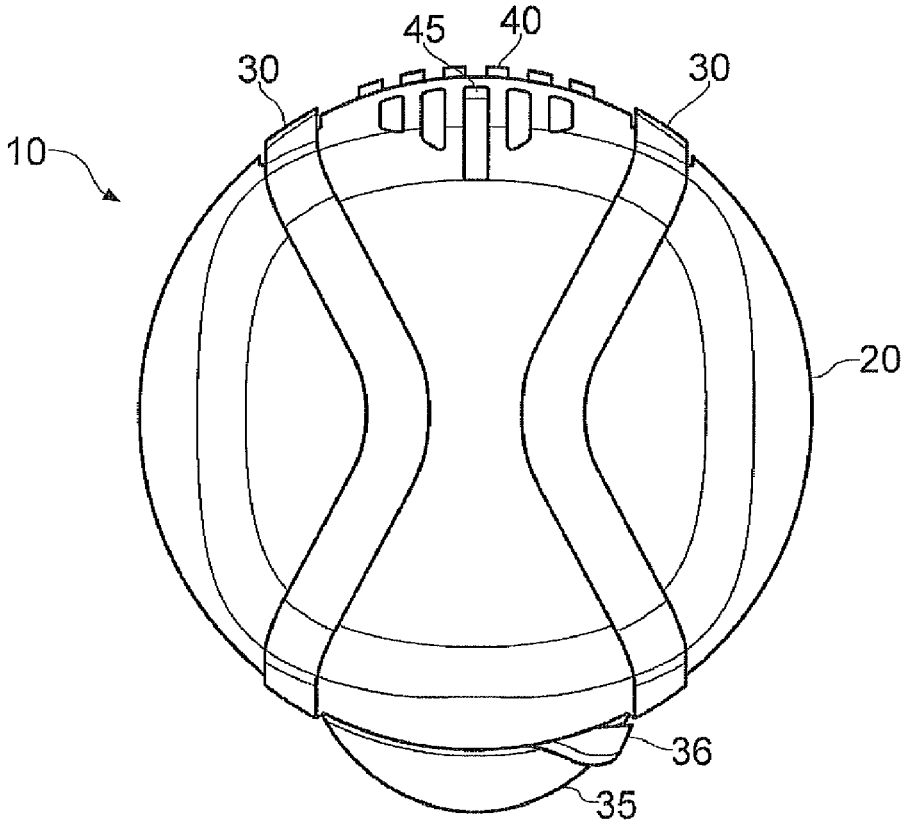
FIG. 2 is a plan view of the closure of FIG. 1.
Figure 3:
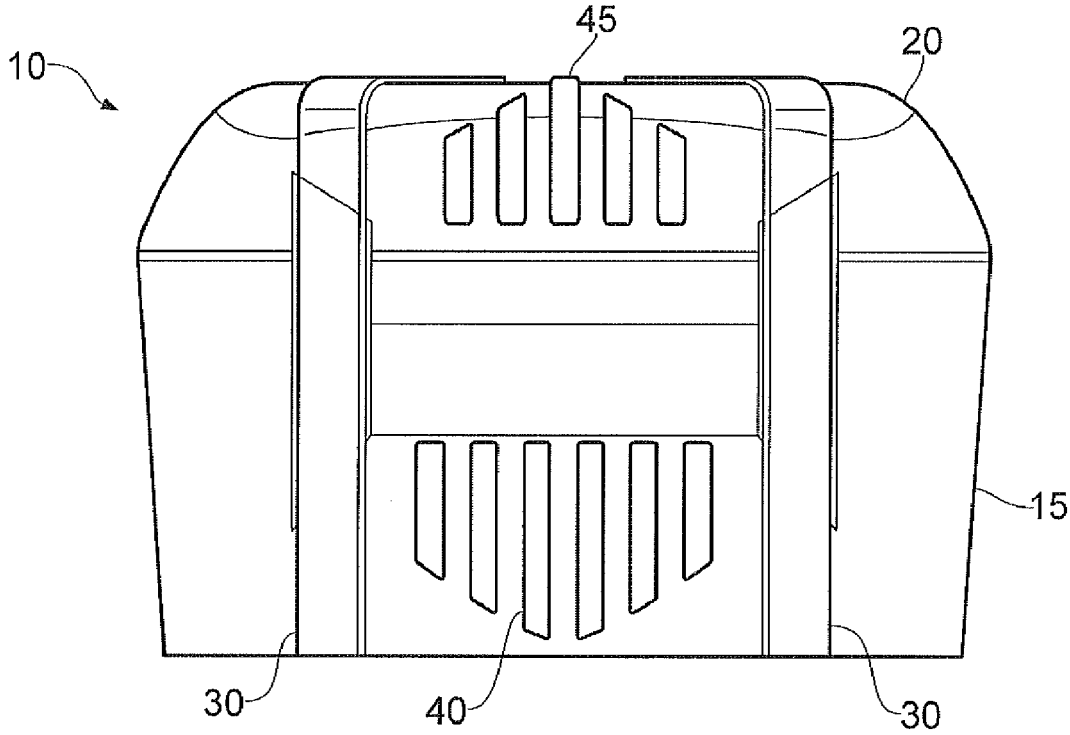
FIG. 3 is a rear elevation of the closure of FIGS. 1 and 2.

Referring first to FIGS. 1 to 3 there is shown a closure generally indicated 10. The closure 10 comprises a generally cylindrical base 15 and a lid 20. In FIG. 1 the closure 10 is shown mounted to a container neck 25.

Figure 4:
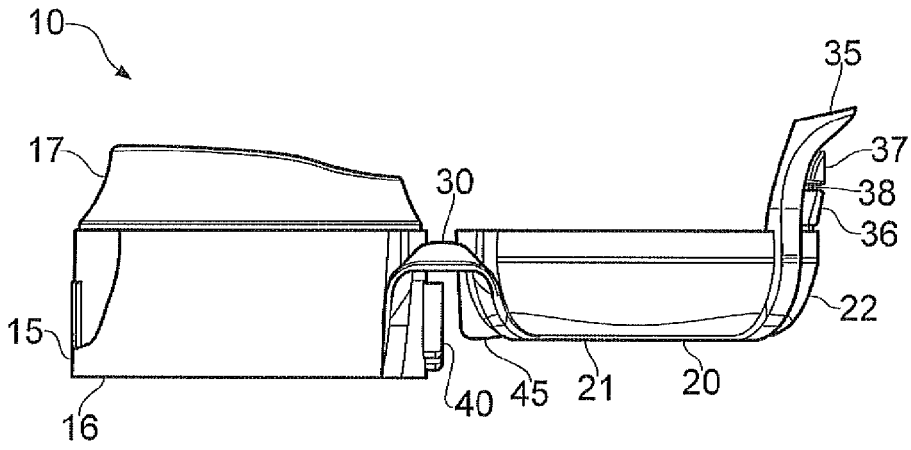
FIG. 4 is a side elevation of the closure of FIGS. 1 to 3 shown in an as-moulded condition.

Referring now also to FIG. 4 (in which the closure is shown in an open, as-moulded condition) the base comprises a generally cylindrical lower section which continues at one end into a generally frusto-conical pouring section 17.

The lid 20 comprises a generally circular top plate 21 and a curved sidewall 22 which extends from the periphery of the plate 21. The base 15 and lid 20 are connected by a hinge in the form of a pair of straps 30 which join the base lower section 16 to the lid sidewall 22.

At the front of the sidewall 22 a D-shape hoop 35 depends. The hoop 35 carries a tamper evident tab 36 and a welding portion 37. The tab 36 and portion 37 are connected by a frangible web 38.

Figure 5:
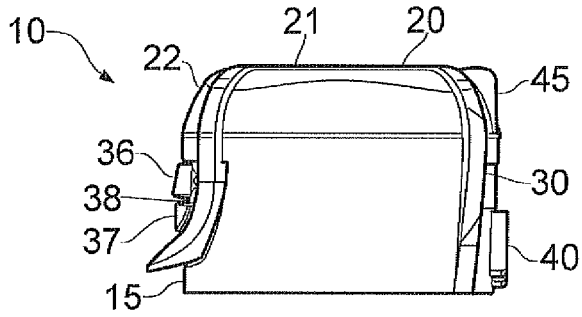
FIG. 5 is a side elevation of the closure of FIG. 4 shown closed prior to first opening.
Figure 6:
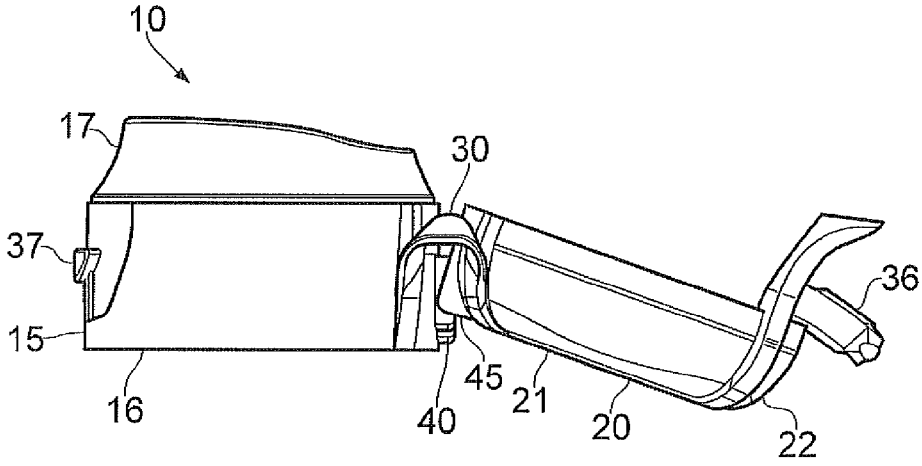
FIG. 6 is a side elevation of the closure of FIG. 5 shown in an open position.

Following moulding the lid 20 is closed onto the base 15 as shown in FIG. 5. The welding portion 37 is then welded onto the base lower portion 16. Importantly, the tab 36 is not welded. In order to open the lid 20 the tab 36 must therefore be torn away from the portion 37. In this embodiment the tab 36 is fixedly connected to the hoop 36 at one end and therefore remains on the hoop 36 as shown in FIG. 6. With the tab released from the portion 37 the hoop 36 must then be pulled slightly away from the base 15 in order for it to pass over the now fixed portion 37.

The base lower portion is provided with an array of mutually spaced ribs 40 which extend between the hinge straps 30. Similarly the lid sidewall 22 is provided with an array of mutually spaced ribs 45 which also extend between the hinge straps 30. As shown best in FIG. 3 the rib arrays 40, 45 are staggered, that is to say that they are not co-linear. More specifically, the spacing between the ribs of the arrays 40, 45 is approximately the same as the width of the ribs in the other array.

Figure 7:
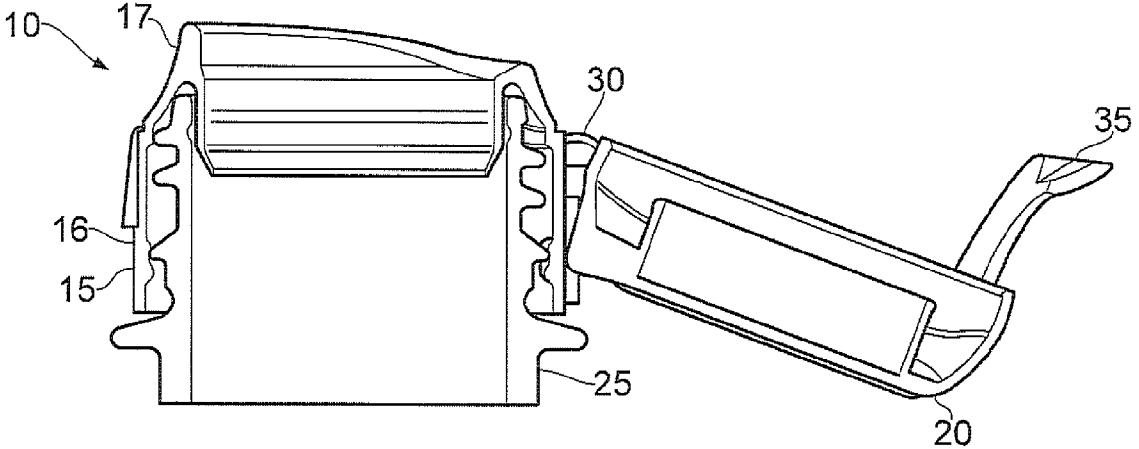
FIG. 7 is a section of the closure of FIG. 6 shown fitted to a container.
Figure 8:
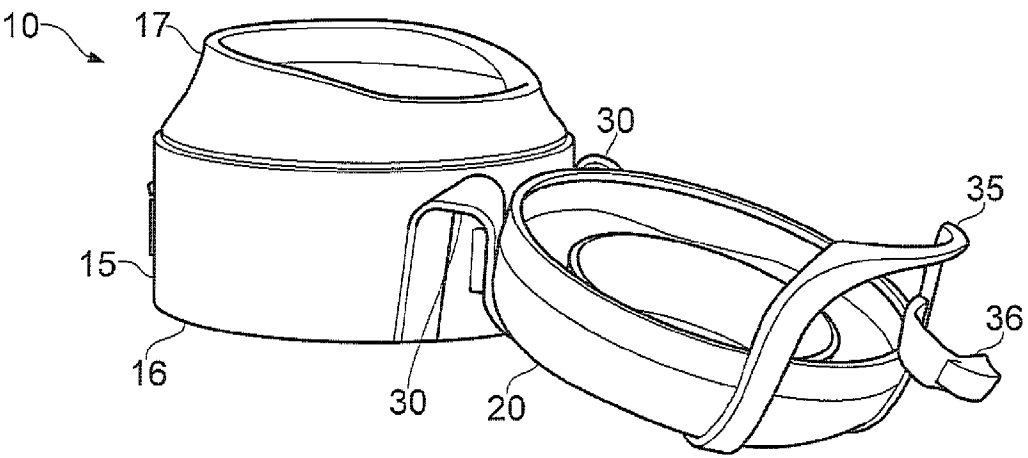
FIG. 8 is a rear perspective view of the closure of FIG. 6.
Figure 9:
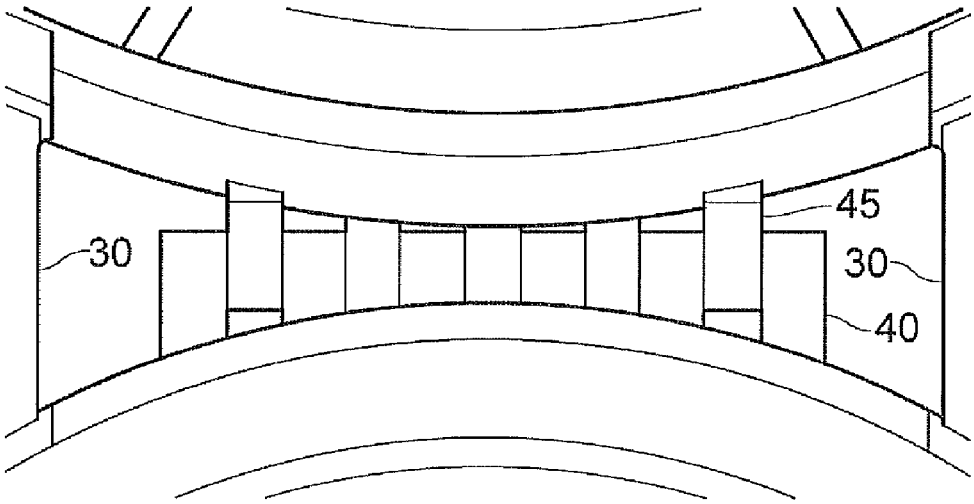
FIG. 9 is a magnified view of the hinge region of the closure of FIGS. 6 to 8.

In use, after the lid 20 is opened for the first time it can be pivoted with respect to the base to the position shown in FIG. 6. As the lid approaches the base towards the position shown in FIG. 6 the rib arrays 40, 45 interengage and interdigitate as shown best in FIG. 9. The width of the ribs in the arrays and the spacing thereof are chosen to provide a tight fit so that the lid 20 is retained stably in the position shown in FIGS. 6 to 8 and resist movement away from this position which might be encouraged by resilience in the hinge straps 30.

What is claimed is:

1. A closure having a base and a lid joined by a hinge, the hinge comprising a pair of straps, the lid being movable between a closed and an open position, the base provided with an array of a plurality of mutually spaced projections and the lid provided with an array of a plurality of mutually spaced projections, the arrays extending between the straps, the projections of the base interdigitating with the projections of the lid when the lid is in the open position to stably retain the lid in the open position.

2. The closure as claimed in claim 1, in which the projections comprise ribs.

3. The closure as claimed in claim 2, in which retention of the lid in the open position is reversible.

4. The closure as claimed in claim 1, in which the projections are provided in the region of the hinge.

5. The closure as claimed in claim 1, further comprising tamper evident means.

6. The closure as claimed in claim 1, in which the base comprises a pouring section.

7. The closure as claimed in claim 1, in which the projections in each array increase in length towards the center of the array.

8. The closure as claimed in claim 1, wherein the straps extend across the lid.

9. A system, comprising: a container; a closure coupled to the container, an array of a plurality of mutually spaced ribs projecting from a base of the closure and an array of a plurality of mutually spaced ribs projecting from a lid of the closure, the ribs of the base interdigitating with the ribs of the lid when the lid is in an open position, a spacing between the ribs of each array approximately equal to a width of the ribs in the other array; and a hinge comprising a pair of straps joining the base to the lid, the arrays of ribs extending between the straps.

10. The system of claim 9, wherein the straps form a D-shape hoop depending at a front of a sidewall of the lid.

11. The system of claim 9, wherein the ribs projecting from the base are staggered from the ribs projecting from the lid.

12. The system of claim 9, wherein the spacing and the width of the ribs of both arrays are chosen to provide a tight fit.

13. The system of claim 9, wherein the straps extend across the lid.

14. A closure comprising:

a base and a lid joined by a pair of hinge straps, the lid movable between a closed and an open position;

an array of a plurality of mutually spaced surface formations projecting from the base and an array of a plurality of mutually spaced projections projecting from the lid, the arrays extending between the straps, the surface formations projecting from the base interdigitating with the surface formations projecting from the lid when the lid is in the open position.

15. The closure of claim 14, wherein a spacing between the surface projections of each array is approximately equal to a width of the surface projections in the other array.

16. The closure of claim 14, wherein the straps form a D-shape hoop depending at a front of a sidewall of the lid.

17. The closure of claim 14, wherein the straps are resilient.

18. The closure of claim 14, wherein the straps extend across the lid.

* * * * *